US008236468B2

(12) United States Patent
Sakai

(10) Patent No.: US 8,236,468 B2
(45) Date of Patent: Aug. 7, 2012

(54) ORGANIC PHOTORECEPTOR, IMAGE FORMING APPARATUS, AND PROCESS CARTRIDGE

(75) Inventor: Eiichi Sakai, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 367 days.

(21) Appl. No.: 12/581,289

(22) Filed: Oct. 19, 2009

(65) Prior Publication Data

US 2010/0098458 A1 Apr. 22, 2010

(30) Foreign Application Priority Data

Oct. 22, 2008 (JP) ..... 2008-271612

(51) Int. Cl.
*G03G 5/00* (2006.01)
*G03G 15/04* (2006.01)

(52) U.S. Cl. ..... 430/65; 430/60; 399/115

(58) Field of Classification Search ..... 430/60–65; 399/115

See application file for complete search history.

(56) References Cited

U.S. PATENT DOCUMENTS 4,349,617 A * 9/1982 Kawashiri et al. ..... 430/58.55
2006/0284194 A1 * 12/2006 Mishra et al. ..... 257/94

FOREIGN PATENT DOCUMENTS

JP 4303846 10/1992
JP 8328283 12/1996

* cited by examiner

*Primary Examiner* — Christopher Rodee
*Assistant Examiner* — Jonathan Jelsma
(74) *Attorney, Agent, or Firm* — Lucas & Mercanti, LLP

(57) ABSTRACT

In the present invention, an objective is to provide an organic photoreceptor exhibiting extremely high moire resistance, but also to provide an organic photoreceptor capable of acquiring a high quality image to realize no generation of image defects such as black spots or the like. Also disclosed is an organic photoreceptor possessing a conductive support and layered thereon, an intermediate layer, a charge generation layer and a charge transport layer in this order, wherein the intermediate layer possesses porous silica in which metal oxide is encapsulated.

5 Claims, 3 Drawing Sheets

ORGANIC PHOTORECEPTOR, IMAGE FORMING APPARATUS, AND PROCESS CARTRIDGE

This application claims priority from Japanese Patent Application No. 2008-271612 filed on Oct. 22, 2008, which is incorporated hereinto by reference.

TECHNICAL FIELD

The present invention relates to an organic photoreceptor used for an electrophotographic image forming apparatus and so forth, and to an image forming apparatus fitted with the organic photoreceptor and a process cartridge thereof.

BACKGROUND

In recent years, high image quality of electrophotographic image forming apparatuses has increasingly been demanded.

As to an apparatus for image formation, a method by which a digital method is employed, writing in the digital method is conducted by using a light source typified by semiconductor laser, and an image is obtained via reverse development becomes mainstream.

Since a semiconductor laser source exhibits coherency, reflected light from the layer interface of a photoreceptor and from a substrate causes complicated interference, whereby there appears a problem such that image defects referred to as so-called moire are generated.

Correspondingly, various techniques to improve the photoreceptor have been investigated so far.

For example, there are a method of cutting the surface of a conductive substrate with a bite, and a method of conducting a blast treatment for roughening the surface to appropriately scatter light, but there appears problems such that in the former case, burr is produced during a cutting work, resulting in generation of image defects, and in the latter case, impurities are penetrated into the substrate via the blast treatment, resulting in generation of image defects.

In this case, a technique by which metal oxide particles typified by titanium dioxide particles are dispersed and contained in an intermediate layer of the photoreceptor to scatter light appropriately in a subbing layer has been actively studied (refer to Patent Documents 1 and 2). However, when the titanium dioxide content is increased in order to improve moire resistance, produced is a problem such that titanium dioxide particles are partially coagulated in the intermediate layer, and a bridging structure is formed in the layer, whereby leakage of charge through the above-described portion is generated in the case of application to the photoreceptor. In order to solve this problem, the surface of titanium dioxide is subjected to an organic or inorganic treatment to increase electrical resistance, and a binder resin in the intermediate layer is designed to be set to high resistance, but results obtained via these trials are still insufficient. Accordingly, reduction of moire resistance and black spot defects has not still been satisfied at the same time in the case of an electrophotographic photoreceptor used in an image forming apparatus fitted with an inherent light source, resulting in a big problem to be solved.

(Patent Document 1) Japanese Patent O.P.I. Publication No. 4-303846

(Patent Document 2) Japanese Patent O.P.I. Publication No. 8-328283

SUMMARY

The present invention has been made on the basis of the above-described situation, and it is an object of the present invention not only to provide an organic photoreceptor exhibiting extremely high moire resistance, but also to provide an organic photoreceptor capable of acquiring a high quality image to realize no generation of image defects such as black spots or the like.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
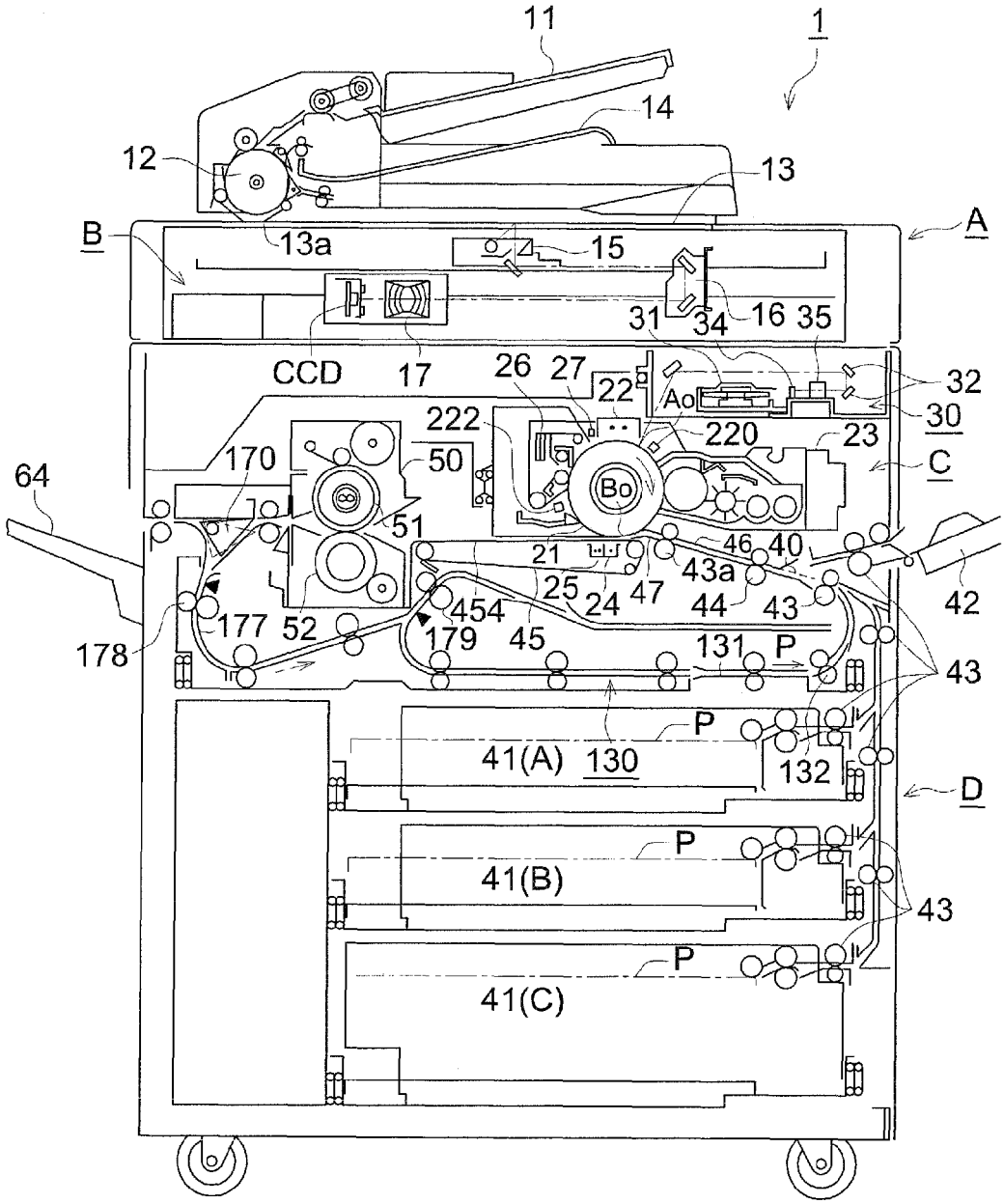
FIG. 1 shows a schematic diagram in which functions for an image forming apparatus are introduced.

After considerable effort during intensive studies, the inventor has found out that to contain inorganic particles exhibiting excellent scattering caused by coherent laser light or the like in an intermediate layer of an organic photoreceptor is extremely effective as an object of the present invention, and has accomplished the present invention. The present invention is accomplished by the following structures.

(Structure 1) An organic photoreceptor comprising a conductive support and layered thereon, an intermediate layer, a charge generation layer and a charge transport layer in this order, wherein the intermediate layer comprises porous silica in which metal oxide is encapsulated.

(Structure 2) The organic photoreceptor of Structure 1, wherein the metal oxide comprises at least one selected from the group consisting of a titanium dioxide particle, an alumina particle, a zinc oxide particle and a tin oxide particle.

(Structure 3) An image forming apparatus to repeatedly conduct image formation, comprising an organic photoreceptor and provided thereabout, a charging device, an exposure device equipped with a coherent light source and a reversal development device, wherein the organic photoreceptor comprises the organic photoreceptor of Structure 1 or 2.

(Structure 4) A process cartridge for the image forming apparatus of Structure 3, comprising at least one of a charging device, an image exposure light source and a developing device, integrally supported with the organic photoreceptor of Structure 1 or 2, the process cartridge removable from the image forming apparatus.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

It is a feature that an organic photoreceptor of the present invention possesses a conductive support and layered thereon, at least an intermediate layer, a charge generation layer and a charge transport layer in this order, wherein the intermediate layer comprises porous silica in which metal oxide is encapsulated.

An organic photoreceptor of the present invention is capable of not only exhibiting high moire resistance, but also acquiring a high quality image with no generation of image defects such as black spots or the like.

Next, the configuration of the organic photoreceptor in the present invention will be described in detail.

[Porous Silica in which Metal Oxide is Encapsulated in the Present Invention]

The porous silica in which metal oxide is encapsulated, which is used in the present invention, is composed of an outer wall formed of porous silica and metal oxide encapsulated in a core portion on which the outer wall is provided as a shell. "Encapsulation" described herein means a state of being encapsulated by an outer wall formed of porous silica, and the core portion is not necessary to be entirely sealed. The porous silica in which metal oxide is encapsulated has a number average primary particle diameter of 0.05-1.0 μm.

(Metal Oxide)

Examples of metal oxide used in the present invention to form metal oxide particles include silicon oxide, magnesium oxide, zinc oxide, lead oxide, aluminum oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide, niobium oxide, molybdenum oxide, vanadium oxide and so forth. However, the metal oxide is preferably a material different from silica (silicon oxide) to form the outer wall. Specifically, metal oxide particles made of titanium dioxide, aluminum, zinc oxide, tin oxide and so forth are preferable. Of these, titanium dioxide is specifically preferable in view of prevention of moire. In the case of titanium dioxide, one having a rutile type crystalline structure is preferable.

Further, metal oxide used in the present invention is preferably prepared by commonly known conventional manufacturing methods such as a vapor deposition method, a chlorine method, a sulfuric acid method, a plasma method, an electrolytic method and so forth.

Metal oxide used in the present invention preferably has a number average primary particle diameter of 1-400 nm, and more preferably has a number average primary particle diameter of 20-300 nm.

As to the porous silica in which the above-described metal oxide is encapsulated, and a number average primary particle diameter of metal oxide particles, an enlarged micrograph was photographed at a magnification of 10000 times employing a scanning electron microscope (manufactured by JEOL Ltd.), and conducted was analysis of the photographic image in which 300 particles are taken at random by a scanner employing an automatic image processing analyzer (LUZEX AP, manufactured by Nireco Corporation) fitted with software version Ver. 1.32 to determine a number average primary particle diameter.

The content of metal oxide in porous silica in which metal oxide is encapsulated in the present invention is preferably 20-300 parts by weight, and is more preferably 40-200 parts by weight with respect to 100 parts by weight of the porous silica.

The above-described metal oxide may be subjected to a surface modification treatment. Those which are commonly known are usable as the surface modifier, and specifically usable examples thereof include a silane coupling agent, a titanium coupling agent, an aluminum coupling agent and so forth.

(Porous Silica)

Figure 4:
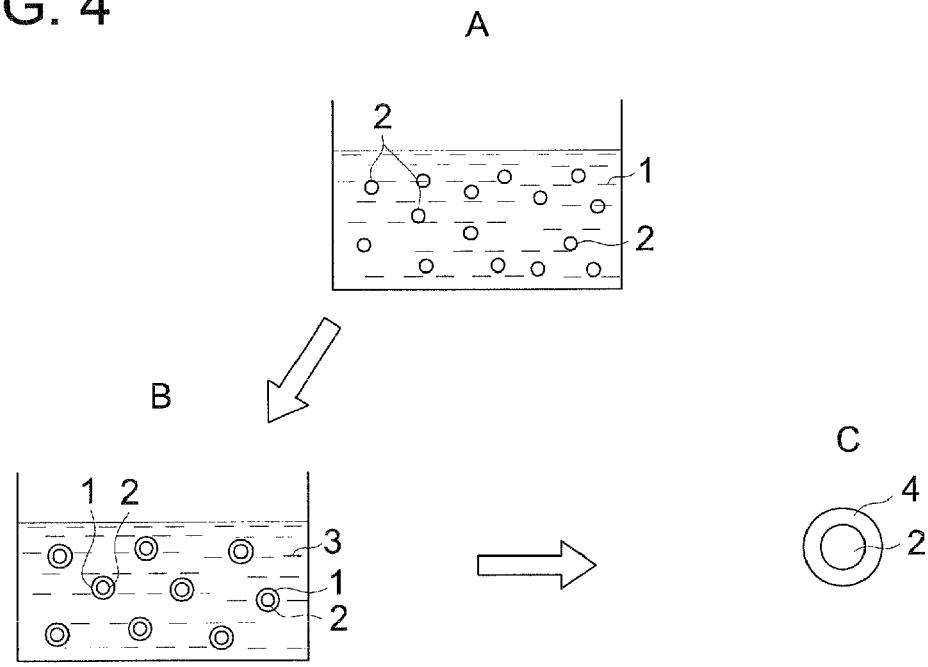
FIG. 4 shows explanation drawings of a method of preparing porous silica in which metal oxide is encapsulated.

Porous material is a material having a number of fine pores, and the pores have regular shape or irregular shape caused by compression and fluidity in the formation process. Silica having the outer wall formed of such the material is porous silica of the present invention. The fine pore preferably has a particle of 1-300 nm, and more preferably has a particle of 10-100 nm. When the fine pore diameter falls within this range, not only a degree of dispersion becomes high, but also holding capability for metal oxide becomes high. Further, the BET specific surface area is preferably at least 400 $m^2/g$, and more preferably at least 650 $m^2/g$. The porous silica of the present invention may be silica having the above-described configuration. As a method of forming porous silica, commonly known methods can be utilized, but the following method is preferably usable in view of an easy encapsulation of metal oxide and easy formation of porous silica. The porous silica to form the outer wall is formed as porous silica in which metal oxide is encapsulated, as described in a method of preparing porous silica in which metal oxide is encapsulated in FIG. 4 shown below, by using matter in the form of liquid, called sodium silicate (water glass), in which silicic acid anhydride ($SiO_2$) and sodium oxide ($Na_2O$) are mixed in any ratio.

Water glass tends to have 20-40% of $SiO_2$ in molar ratio, and typical examples of the water glass specified as water glass No. 1, water glass No. 2, water glass No. 3 or the like in accordance with Japanese Industrial standards (JIS K 1408).

{Method of Manufacturing Porous Silica in which Metal Oxide (Titanium Dioxide) is Encapsulated}

Though this is not specifically limited, titanium dioxide having a number average primary particle diameter of roughly 1-100 nm is added and mixed in an organic solvent in which a dispersing agent such as polyoxyethylene laurylether or the like, for example, is mixed, and the system is stirred, followed by further sufficiently stirring to prepare a dispersed suspension.

Next, the above-described dispersed suspension is added into water glass No. 1 to prepare O/W type (oil-in-water type) emulsion. Numeral 1 represents water glass, and numeral 2 represents an oil droplet of an organic solvent in which titanium dioxide is dispersed (refer to A of FIG. 4). This emulsion solution is charged in organic solvent 3 in which a dispersing agent such as polyoxyethylene laurylether or the like is added, followed by stirring again at high speed (refer to B of FIG. 4). By doing this, an O/W/O type (oil-in-water-in-oil type) emulsion solution, in which first oil phase (O1) as the innermost phase, second oil phase (O2) as the outermost phase and water phase (W) as the intermediate phase are double-phase-emulsified, is prepared; a precipitant such as ammonium sulfate or the like is added for precipitation; and particles to be formed are separated via filtration, followed by washing, drying and heating to form the titanium dioxide particle encapsulated by outer wall 4 formed of porous silica, since the organic solvent inside the porous silica in which metal oxide is encapsulated is also volatilized (refer to C of FIG. 4).

Intermediate Layer

In the present invention, an intermediate layer containing porous silica in which metal oxide is encapsulated as described before is provided between a conductive support and a photosensitive layer.

Porous silica in which metal oxide is encapsulated in the present invention is used in an intermediate layer, and use of the porous silica enhances light scattering performance in the intermediate layer, whereby generation of moire can be more effectively inhibited. It is for this reason that presumably, light is scattered not only on the silica particle surface, but also on the surface of metal oxide encapsulated inside or the porosity interface in the inside of a particle. By using porous silica in which metal oxide is encapsulated in the present invention in an intermediate layer, coagulation of porous silica or uneven region is difficult to be generated in an intermediate layer though increasing thickness of the intermediate layer, since dispersibility of porous silica in an intermediate layer coating solution is excellent, whereby generation of black spots is effectively prevented, and rise of residual potential becomes difficult to be generated, resulting in formation of an excellent organic photoreceptor.

The intermediate layer coating solution prepared for forming an intermediate layer of the present invention is composed of a binder resin and a dispersing solvent other than porous silica in which metal oxide is encapsulated as described before.

As to a ratio of porous silica in which metal oxide is encapsulated in an intermediate layer, a weight ratio of the porous silica to the binder resin contained in the intermediate layer is preferably 3.0-20 times (when weight of the binder resin is set to 1). By using porous silica in which metal oxide is encapsulated in the present invention in the intermediate layer, which exhibits high density, use of the porous silica enhances light scattering performance in the intermediate layer, whereby generation of moire can be more effectively inhibited.

On the other hand, as a binder resin to disperse these particles and form a layer structure of the intermediate layer, a polyamide resin is preferable in order to obtain excellent dispersibility of particles, but the following polyamide resins are specifically preferable.

As a binder resin used for the intermediate layer, an alcohol-soluble polyamide resin is preferable. As a binder resin used for the intermediate layer in the photoreceptor, a resin exhibiting excellent solvent solubility is desired to form an intermediate layer having a uniform thickness. As such the alcohol-soluble polyamide resin, known is a copolymerized polyamide resin or a methoxy-methylated polyamide resin composed of a chemical structure having not so many carbon chains between amide bonds such as the foregoing 6-nylon or the like, but the following polyamides other than these are preferably usable.

N-1

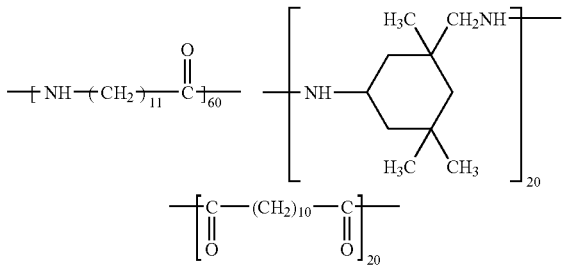

N-2

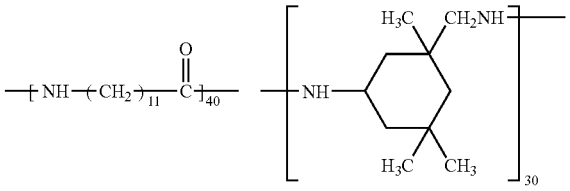

-continued

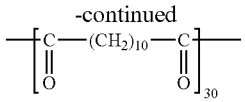

N-3

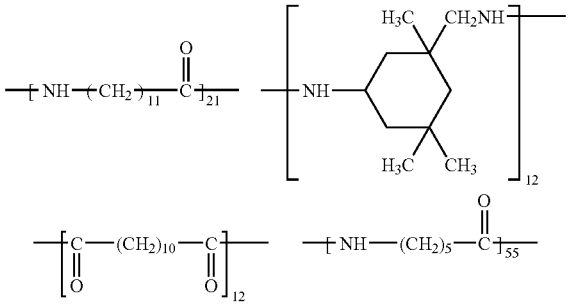

N-4

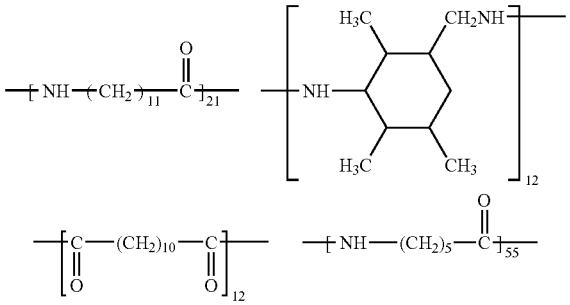

N-5

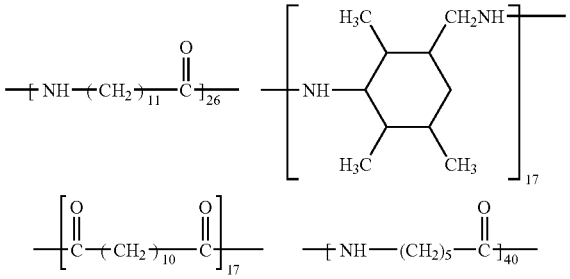

Further, the above-described polyamide resin preferably has a number average molecular weight of 5,000-80,000, and more preferably has a number average molecular weight of 10,000-60,000. In the case of a number average molecular weight of 5,000 or less, evenness in thickness of the intermediate layer is degraded, whereby the effect of the present invention is not sufficiently produced. On the other hand, in the case of a number average molecular weight of at least 80,000, solvent solubility of a resin is degraded, and a coagulated resin is easy to be produced in the intermediate layer, whereby generation of black spots and degradation of dot images are easy to be produced.

A part of the above-described polyamide resin has been commercially available, for example, under the trade name of VESTAMELT X1010, X4685 or the like, produced by Daicel-Degussa Ltd. They can be prepared by a commonly known method of synthesizing polyamide, but one synthesizing example is described below.

As a solvent to dissolve the above-described polyamide resin to prepare a coating solution, alcohol having 2-4 carbon atoms such as ethanol, n-propyl alcohol, iso-propyl alcohol, n-butanol, t-butanol, sec-butanol or the like is preferable in view of solubility of polyamide and coatability of the coating solution. The solvent in the total solvent has a content of 30-100% by weight, preferably has a content of 40-100% by weight, and more preferably has a content of 50-100% by weight. Examples of the auxiliary solvent to produce a favorable effect in combination with the foregoing solvent include methanol, benzyl alcohol, toluene, methylene chloride, cyclohexanone, tetrahydrofuran and so forth.

The intermediate layer preferably has a thickness of 0.5-15 μm. When the intermediate layer has a thickness of less than 0.5 μm, black spots and so forth are easy to be generated, whereby degradation of the image caused by moire is easy to be produced. When the intermediate layer has a thickness exceeding 15 μm, rise in residual potential is easy to be generated. The intermediate layer more preferably has a thickness of 0.5-5 μm.

It is also preferable that the intermediate layer is substantially an insulating layer. Herein, the insulating layer means a layer having a volume resistance of at least $1\times10^{8}$ Ω·cm. The intermediate layer as well as the protective layer preferably has a volume resistance of $1\times10^{8}$-$1\times10^{15}$ Ω·cm, more preferably has a volume resistance of $1\times10^{9}$-$1\times10^{14}$ Ω·cm, and still more preferably has a volume resistance of $2\times10^{9}$-$1\times10^{13}$ Ω·cm. The volume resistance can be measured as described below.

The measurement conditions: in accordance with C2318-1975.

Measuring device: HIRESTA IP manufactured by Mitsubishi Chemical Corporation

Measuring probe: Measuring probe HRS

Applied voltage: 500 V

Measuring environment: 30±2° C., 80±5 RH % In the case of a volume resistance of less than $1\times10^{8}$ Ω·cm, a charge blocking property of the intermediate layer is lowered, generation of black spots is increased, and a potential holding property of the organic photoreceptor is deteriorated, whereby no good image quality can be obtained. On the other hand, in the case of a volume resistance exceeding $1\times10^{15}$ Ω·cm, the residual potential in repetitive image formation is easy to be increased, whereby no good image quality can be obtained.

Next, the configuration of an organic photoreceptor of the present invention possessing the above-described intermediate layer will be described in detail.

In the present invention, the organic photoreceptor refers to as an electrophotographic photoreceptor equipped with at least one of a charge generation function essential to the configuration of the electrophotographic photoreceptor, and a charge transport function. It includes all the photoreceptors composed of the commonly known organic charge generating substances or organic charge transfer substances, and the known organic photoreceptors such as the photoreceptor wherein the charge generation function and charge transport function are provided by a polymeric complex.

The configuration of an organic photoreceptor of the present invention has a feature of the foregoing intermediate layer of the present invention, but the following configurations are provided, for example.

(1) A configuration in which an intermediate layer, a charge generation layer and a charge transport layer are layered in order on a conductive support.

(2) A configuration in which an intermediate layer, a charge generation layer, a charge transport layer and a protective layer are layered in order on a conductive support.

The charge transport layer means a layer exhibiting a function to transport charge carrier generated in a charge generation layer via exposure to light onto the organic photoreceptor surface, and the specific detection of the charge transport function can be confirmed by detecting optical conductivity after layering a charge generation layer and a charge transport layer on a conductive support.

Next, the configuration of the organic photoreceptor described in the above (1) will be mainly explained.

Conductive Support

Any of a conductive support in the form of a sheet and a cylindrical conductive support, which is used for a photoreceptor, may be employed, but in order to compactly design an image forming apparatus, the cylindrical conductive support is preferable.

The cylindrical conductive support means a cylindrical support to endlessly form images via rotation, and the conductive support having a streightness of 0.1 mm or less and a swing width of 0.1 mm or less is preferable. When the straightness and the swing width exceed the above-described ranges, good images are difficult to be formed.

As to the conductive material, a metal drum made of aluminum, nickel or the like, a plastic drum on which aluminum, tin oxide, indium oxide or the like is evaporated, and a paper or plastic drum on which a conductive material is coated are usable. The conductive support preferably has a specific resistance of $10^{3}$ Ωcm or less at room temperature. The conductive support of the present invention is most preferably an aluminum support. The aluminum support in which a component of manganese, zinc, magnesium or the like in addition to aluminum as a principal component is mixed is utilized.

Intermediate Layer

In the present invention, an intermediate layer containing porous silica in which metal oxide is encapsulated as described before is provided between a conductive support and a photosensitive layer.

Photosensitive Layer

The photosensitive layer configuration of the photoreceptor of the present invention may be a structure in which photosensitive layer function is separated into charge generation layer (CGL) and charge transport layer (CTL), which is provided on the foregoing intermediate layer. By taking the structure in which the function is separated, increase in residual potential caused by repetitive use can be controlled and minimized, and another electrophotographic property is easily controlled so as to suit the objective. In the case of a negatively charging photoreceptor, preferable is a configuration in which charge generation layer (CGL) is provided on an intermediate layer, and charge transport layer is provided thereon.

The photosensitive configuration of a function separation negatively charging photoreceptor will be described.

Charge Generation Layer

Examples of the charge generation material usable for the organic photoreceptor of the present invention include commonly known charge generation materials such as a phthalocyanine pigment, an azo pigment, a perylene pigment, a polycyclic quinine pigment and so forth. These charge generation materials are used singly, or in combination of at least two kinds.

When using a binder as dispersing medium of CGM for a charge generation layer, a commonly known resin is usable as the binder, but examples of the most preferable resins include a formal resin, a butyral resin, a silicone resin, a silicone-modified butyral resin, a phenoxy resin and so forth. The ratio of the charge generation material to the resin binder is preferably 20-600 parts by weight, with respect to 100 parts by weight of the binder resin. The increase in residual potential caused by repetitive use can be minimized by using such the resin. The charge generation layer preferably has a thickness of 0.3-2 μm.

Charge Transport Layer

The charge transport layer of the present invention is composed of plural charge transport layer, and used may be a configuration in which inorganic particles of the present invention are contained in a charge transport layer as the outermost layer.

The charge transport layer contains charge transport material (CTM) and a binder resin to disperse CTM and form a layer. Additives such as the foregoing inorganic particles, an antioxidant and so forth may be optionally contained as other substances.

A hole transporting (P-type) charge transport material (CTM) is usable as charge transfer material (CTM). Examples thereof include a triphenylamine derivative, a hydrazone compound, a styryl compound, a benzidine compound, a butadiene compound and so forth. Layer formation is conducted by usually dissolving the charge transport material in an appropriate binder resin.

The binder resin usable in charge transport layer (CTL) can be any of a thermoplastic resin and a thermosetting resin. Examples thereof include resins such as a polystyrene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymer resin having at least two of repeating unit structures of the above-described resins. Further, a polymer organic semiconductor such as poly-N-vinyl carbazole or the like other than these insulating resins is cited. Of these resins, most preferable is a polycarbonate resin exhibiting low water absorption, excellent dispersibility of CTM, and excellent electrophotographic properties.

The ratio of a charge transport material to a binder resin is preferably 50-200 parts by weight with respect to 100 parts by weight of the binder resin.

The charge transport layer preferably has a total thickness of 10-30 μm. In the case of the total thickness of less than 10 μm, the latent image potential during developing is difficult to be acquired, and degradation in image density and dot reproduction is easily generated. On the other hand, in the case of the total thickness exceeding 30 μm, diffusion of charge carrier (diffusion of charge carrier generated in a charge generation layer) becomes large, whereby dot reproduction is easily degraded. Further, when the charge transport layer is composed of plural layers, the charge transport layer as a surface layer preferably has a thickness of 1.0-8.0 μm.

Examples of the solvent or the dispersing medium usable for forming an intermediate layer, a charge generation layer, a charge transport layer and so forth include n-butylamine, diethylamine, ethylenediamine, isopropanolamine, triethanolamine, triethylene diamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide, methyl cellosolve, and so forth. The present invention is not limited thereto, but environmental conscious solvents such as tetrahydrofuran, methyl ethyl ketone and so forth are preferably used. These solvents may also be used singly or in combination with at least two kinds of mixed solvents.

Next, as coating methods to prepare organic photoreceptors, an immersion coating method, a spray coating method, a slide hopper type coating method, and so forth are used.

When coating an intermediate layer containing porous silica in which metal oxide of the present invention is encapsulated, in the case of the porous silica in which metal oxide is encapsulated, specifically having a particle diameter exceeding 0.1 μm, a slide hopper type coating method or a spray coating method is preferably used in order to avoid an influence of precipitation of porous silica in a coating solution. Further, when forming a charge transport layer composed of plural layers, a slide hopper type coating apparatus or a spray coating apparatus is preferably used in the case of coating of the second layer or more of the charge transport layer, in order not to needlessly dissolve the lower layer previously coated.

Further, the surface layer of the photoreceptor of the present invention preferably contains an antioxidant. The surface layer tends to be oxidized with an active gas such as $NO_x$, ozone or the like during electrification of a photoreceptor, resulting in generation of image blurring, but generation of the image blurring can be avoided via coexistence of the antioxidant. The antioxidant typically means a material exhibiting a property to prevent or inhibit oxygen action under the condition of light, heat, discharge or the like with respect to an autooxidation product present in an organic photoreceptor or on the surface of the organic photoreceptor.

Examples of the solvent or the dispersing medium usable for forming an intermediate layer, a charge generation layer, a charge transport layer and so forth include n-butylamine, diethylamine, ethylenediamine, isopropanolamine, triethanolamine, triethylene diamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide, methyl cellosolve, and so forth. The present invention is not limited thereto, but dichloromethane, 1,2-dichloroethane, methyl ethyl ketone and so forth are preferably used. These solvents may also be used singly or in combination with at least two kinds of mixed solvents.

Next, an image forming apparatus fitted with the organic photoreceptor of the present invention will be described.

Image forming apparatus 1 shown in FIG. 1 is a digital image forming apparatus. It possesses image reading section A, image processing section B, image forming section C, and transfer paper conveyance section D as a transfer paper conveyance device.

An automatic document feeding device for automatically feeding documents is arranged on the top of image reading section A. The documents placed on document platen 11 as conveyed sheet by sheet employing document conveying roller 12, and the image is read at reading position 13*a*. The document having been read is ejected onto document ejection tray 14 by document conveying roller 12.

In the meantime, the image of the document placed on plate glass 13 is read by reading operation at speed v by first mirror unit 15 having an illumination lamp constituting a scanning optical system and a first mirror, and by the movement of second mirror unit 16 having the second and third mirrors located at the V-shaped position at speed v/2 in the same direction.

The scanned images are formed on the light receiving surface of image-capturing device (CCD) as a line sensor through projection lens 17. The linear optical images formed on image-capturing device (CCD) are sequentially subjected to photoelectric conversion into electric signals (luminance signals). Then they are subjected to analog-to-digital conversion, and then to such processing as density conversion and filtering in image processing section B. After that, image data is stored in the memory.

Image forming section C as an image forming unit possesses drum-formed photoreceptor 21 as an image carrier; charging device (charging process) 22 for charging photoreceptor 21 on the outer periphery; potential detecting device 220 for detecting the potential on the surface of the charged photoreceptor; developing device (developing process) 23; transfer conveyance belt apparatus 45 as a transfer section (transfer process); cleaning device (cleaning process) 26 for photoreceptor 21; and PCL (pre-charge lamp) 27 as an optical discharging section (optical discharging process). These components are arranged in the order of operations. Further, reflected density detecting section 222 for measuring the reflected density of the patch image developed on photoreceptor 21 is provided downstream from developing device 23. A photoreceptor of the present invention is used as photoreceptor 21, and is driven in the clockwise direction as illustrated.

Rotating photoreceptor 21 is electrically charged uniformly by charging device 22. After that, image exposure is performed based on the image signal called up from the memory of image processing section B by the exposure optical system as image exposure section (image exposure process) 30. In the exposure optical system as image exposure section 30 (also known as writing section), the optical path is bent by reflection mirror 32 through rotating polygon mirror 31, fθ lens 34, and cylindrical lens 35, using the laser diode (not illustrated) as a light emitting source, whereby main scanning is performed. Exposure is carried out at position Ao with reference to photoreceptor 21, and an electrostatic latent image is formed by the rotation (sub-scanning) of photoreceptor 21.

In the image forming apparatus of the present invention, when an electrostatic latent image is formed on the photoreceptor, a coherent light source such as a semiconductor laser, a gas laser or the like is used as an image exposure light source. When conducting image exposure corresponding to image information, employing this image exposure light source, by narrowing a light exposure dot diameter in the writing main scanning direction to the range of 10-50 μm, and conducting a digital exposure on the organic photoreceptor, it is preferred to write at a high resolution of 600-2500 dpi (dpi: the number of dots per 25.4 cm) in view of an acquired high resolution electrophotographic image.

The foregoing exposure light dot diameter means a length of the exposure beam along with the main scanning direction in the area where the intensity of this exposure beam corresponds to $1/e^2$ of the peak light intensity (Ld: measured at the maximum length position).

The light beam to be used includes the beams of the scanning optical system using the semiconductor laser, solid scanner such as an LED and so forth. The distribution of the light intensity includes Gauss distribution and Lorenz distribution. The portion exceeding $1/e^2$ of each peak intensity is assumed as an exposure light dot diameter of the present invention.

The electrostatic latent image on photoreceptor 21 is subject to reverse development by developing device 23, and a visible toner image is formed on the surface of photoreceptor 21. According to the image forming method of the present invention, polymerized toner is utilized as the developer for this developing device. An electrophotographic image exhibiting excellent sharpness can be achieved when the polymerized toner having a uniform shape and particle size is used in combination with the photoreceptor of the present invention.

<Toner>

The electrostatic latent image formed on the photoreceptor of the present invention is visualized as a toner image via development. The toner to be used for the development may be crushed toner or polymerized toner, but the toner of the present invention is preferably a polymerized toner prepared by a polymerization method from the viewpoint of realization of a stable particle size distribution.

The polymerized toner means a toner formed via preparation of a binder resin for the toner, polymerization of a raw material monomer for the binder resin to be of toner shape, and a subsequent chemical treatment, if desired. To be more concrete, the foregoing toner means a toner formed via polymerization reaction such as suspension polymerization, emulsion polymerization or the like, and a particle-to-particle fusing process subsequently carried out, if desired.

In addition, the volume average particle diameter, that is, 50% volume particle diameter (Dv50) is preferably 2-9 μm, and more preferably 3-7 μm. High resolution can be obtained by falling the volume average particle diameter in this range. Further, an existing amount of toner having a fine particle diameter can be reduced in combination with the above-described range, though the toner is one having a small particle diameter, whereby improved dot image reproduction is obtained for a long duration, and stable images exhibiting excellent sensitivity can be formed.

<Developer>

The toner of the present invention may be used as a single component developer or a two-component developer.

When the toner is used as a single component developer, provided is a nonmagnetic single component developer, or a magnetic single component developer containing magnetic particles of approximately 0.1-0.5 μm in size in the toner, and both the nonmagnetic single component developer and the magnetic single component developer are usable.

The toner may be used as a two-component developer by mixing with a carrier. In this case, commonly known materials which are metal such as iron, ferrite, magnetite or the like, an alloy of such the metal and another metal such as aluminum, lead or the like, and so forth are usable as magnetic particles for carrier. Ferrite is specifically preferred. The above-described magnetic particles may preferably have a volume average particle diameter of 15-100 μm, and more preferably have a volume average particle diameter of 25-80 μm.

The volume average particle diameter of carrier can be measured typically by a laser diffraction particle size distribution measuring apparatus equipped with a wet type disperser (HELOS, manufactured by SYMPATEC Corp.).

The carrier is preferably a carrier in which a magnetic particle is coated with a resin, or a so-called resin dispersion type carrier in which a magnetic particle is dispersed in a resin. The resin composition for coating is not specifically limited, but usable examples thereof include an olefin based resin, a styrene based resin, a styrene-acryl based resin, a silicone based resin, an ester based resin, a fluorine-containing polymer based resin and so forth. The resin to prepare the resin dispersion type carrier is not specifically limited, but commonly known resins are usable. Examples thereof include a styrene-acryl based resin, a polyester resin, a fluorine based resin, a phenyl resin and so forth.

In transfer paper conveyance section D, sheet feed units 41(A), 41(B) and 41(C) as a transfer sheet storage device are arranged below the image forming unit, wherein transfer sheets P having different sizes are stored. A manual sheet feed unit 42 for manual feed of the sheets of paper is provided on the side. Transfer sheets P selected by either of the two are fed along sheet conveyance path 40 by guide roller 43, and are temporarily suspended by sheet feed registration roller 44 for correcting the inclination and deviation of transfer sheets P. Then transfer sheets P are again fed and guided by sheet conveyance path 40, pre-transfer roller 43*a*, paper feed path 46 and entry guide plate 47. The toner image on photoreceptor 21 is transferred to transfer sheet P at transfer position Bo by transfer electrode 24, separator electrode 25 and so forth, and transfer sheet P is also separated from the photoreceptor. Then, transfer sheet P is conveyed to transfer conveyance belt 454 of transfer conveyance belt apparatus 45, and conveyed to fixing device 50 by transfer conveyance belt apparatus 45.

Fixing device 50 is equipped with fixing roller 51 and pressure roller 52. When transfer sheet P passes between fixing roller 51 and pressure roller 52, toner is fixed in position by heat and pressure. With the toner image having been fixed thereon, transfer sheet P is ejected onto ejection tray 64.

The above description indicates the case where an image is formed on one side of the transfer sheet. In the case of duplex copying, paper sheet ejection switching member 170 is switched and transfer sheet guide 177 is opened. Transfer sheet P is fed in the direction of an arrow shown in a broken line.

Further, transfer sheet P is fed downward by conveyance device 178 and is switched back by sheet reversing section 179. With the trailing edge of transfer sheet P becoming the leading edge, transfer sheet P is conveyed into sheet feed unit 130 for duplex copying.

Conveyance guide 131 provided on sheet feed unit 130 for duplex copying is moved in the direction of sheet feed by transfer sheet P. Then transfer sheet P is fed again by sheet feed roller 132 and is led to sheet conveyance path 40.

As described above, transfer sheet P is fed in the direction of photoreceptor 21 again, and the toner image is transferred on the reverse side of transfer sheet P. After the image has been fixed by fixing section 50, transfer sheet P is ejected to ejection tray 64.

The image forming apparatus of the present invention can be configured in such a way that the components such as the foregoing photoreceptor, developing device, cleaning device and so forth are integrally combined to a process cartridge, and this unit may be installed in the apparatus main body as a removable unit. It is also possible to arrange such a configuration that at least one of the charging device, the image exposure device, the developing device, the transfer or separation electrode and the cleaning device is integrally supported with the photoreceptor to form a process cartridge as a single removable unit capable of being installed in the apparatus main body, employing a guide device such as a rail of the apparatus main body.

Figure 2:
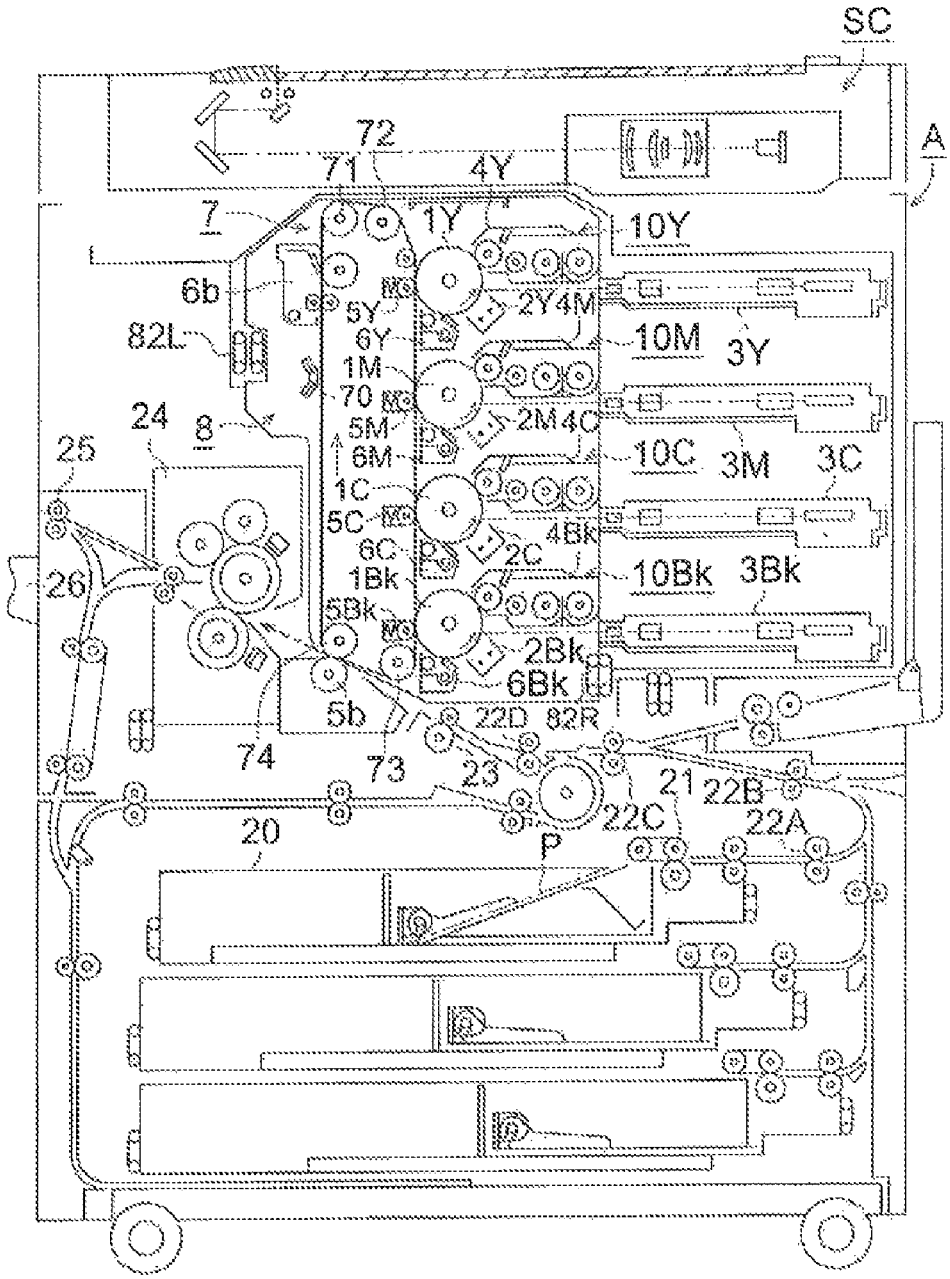
FIG. 2 shows a schematic cross-sectional diagram of a color image forming apparatus as an embodiment of the present invention.

FIG. 2 is a cross-sectional schematic diagram showing a color image forming apparatus as an embodiment of the present invention.

This color image forming apparatus is called the so-called tandem type color image forming apparatus, and comprises four sets of image forming sections (image forming units) 10Y, 10M, 10C, and 10Bk, endless belt shaped intermediate transfer member unit 7, sheet feeding and conveyance device 21, and fixing device 24. The original document reading apparatus SC is placed on top of main unit A of the image forming apparatus.

Image forming section 10Y that forms images of yellow color comprises charging device (charging process) 2Y, exposure device (exposure process) 3Y, developing device (developing process) 4Y, primary transfer roller 5Y as primary transfer section (primary transfer process), and cleaning device 6Y all placed around drum-formed photoreceptor 1Y which acts as the first image supporting body. Image forming section 10M that forms images of magenta color comprises drum-formed photoreceptor 1M which acts as the first image supporting body, charging device 2M, exposure device 3M, developing device 4M, primary transfer roller 5M as a primary transfer section, and cleaning device 6M. Image forming section 10C that forms images of cyan color comprises drum-formed photoreceptor 1C which acts as the first image supporting body, charging device 2C, exposure device 3C, developing device 4C, primary transfer roller 5C as a primary transfer section, and cleaning device 6C. Image forming section 10Bk that forms images of black color comprises drum-formed photoreceptor 1Bk which acts as the first image supporting body, charging device 2Bk, exposure device 3Bk, developing device 4Bk, primary transfer roller 5Bk as a primary transfer section, and cleaning device 6Bk.

Four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, image exposure devices 3Y, 3M, 3C, and 3Bk, rotating developing devices 4Y, 4M, 4C, and 4Bk, and cleaning devices 5Y, 5M, 5C, and 5Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y has, placed around photoreceptor drum 1Y which is the image forming body, charging device 2Y (hereinafter referred to merely as charging unit 2Y or charger 2Y), exposure device 3Y, developing device 4Y, and cleaning device 5Y (hereinafter referred to simply as cleaning device 5Y or as cleaning blade 5Y), and forms yellow (Y) colored toner image on photoreceptor drum 1Y. Further, in the present preferred embodiment, at least photoreceptor drum 1Y, charging device 2Y, developing device 4Y, and cleaning device 5Y in image forming unit 10Y are provided in an integral manner.

Charging device 2Y is a device that applies a uniform electrostatic potential to photoreceptor drum 1Y, and corona discharge type charger unit 2Y is being used for photoreceptor drum 1Y in the present preferred embodiment.

Image exposure device 3Y is a device that conducts light exposure, based on an image signal (Yellow), and forms an electrostatic latent image corresponding to the yellow color image. Exposure device 3Y is one composed of LED arranged in the form of an array in the direction of photoreceptor drum 1Y axis, and an image focusing element (product name: Selfoc lens), or is a laser optical system.

The image forming apparatus of the present invention can be configured in such a way that the constituents such as the foregoing photoreceptor, a developing device, a cleaning device and so forth are integrally combined to a process cartridge (image forming unit), and this image forming unit may be installed in the apparatus main body as a removable unit. It is also possible to arrange such a configuration that at least one of the charging device, the image exposure device, the developing device, the transfer or separation device and the cleaning device is integrally supported with the photoreceptor to form a process cartridge (image forming unit) as a single removable image forming unit, employing a guide device such as a rail of the apparatus main body.

Intermediate transfer member unit 7 in the form of an endless belt is wound around a plurality of rollers, and has endless belt shaped intermediate transfer member 70 which acts as a second image carrier in the shape of a partially conducting endless belt which is supported in a free manner to rotate.

The images of different colors formed by image forming units 10Y, 10M, 10C, and 10Bk, are successively transferred on to rotating endless belt shaped intermediate transfer member 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc.,) is fed from sheet feeding device 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment. Here, the transfer supporting body of the toner image formed on the photoreceptor of the intermediate transfer body or of the transfer material, etc. is comprehensively called the transfer medium.

On the other hand, after the color image is transferred to transfer material P by secondary transfer roller 5*b* functioning as the secondary transfer section, endless belt shaped intermediate transfer member 70 from which transfer material P has been separated due to different radii of curvature is cleaned by During image forming, primary transfer roller 5Bk is at all times contacting against photoreceptor 1Bk. Other primary transfer rollers 5Y, 5M, and 5C come into contact respectively with corresponding photoreceptors 1Y, 1M, and 1C only during color image forming.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

Chassis 8 possesses image forming sections 10Y, 10M, 10C, and 10Bk, and endless belt shaped intermediate transfer member unit 7.

Image forming sections 10Y, 10M, 10C, and 10Bk are arranged in column in the vertical direction. Endless belt shaped intermediate transfer member unit 7 is placed to the left side in the figure of photoreceptor drums 1Y, 1M, 1C, and 1Bk. Endless belt shaped intermediate transfer member unit 70 possesses endless belt shaped intermediate transfer member 70 that can rotate around rollers 71, 72, 73, and 74, primary image transfer rollers 5Y, 5M, 5C, and 5Bk, and cleaning device 6*b*.

Figure 3:
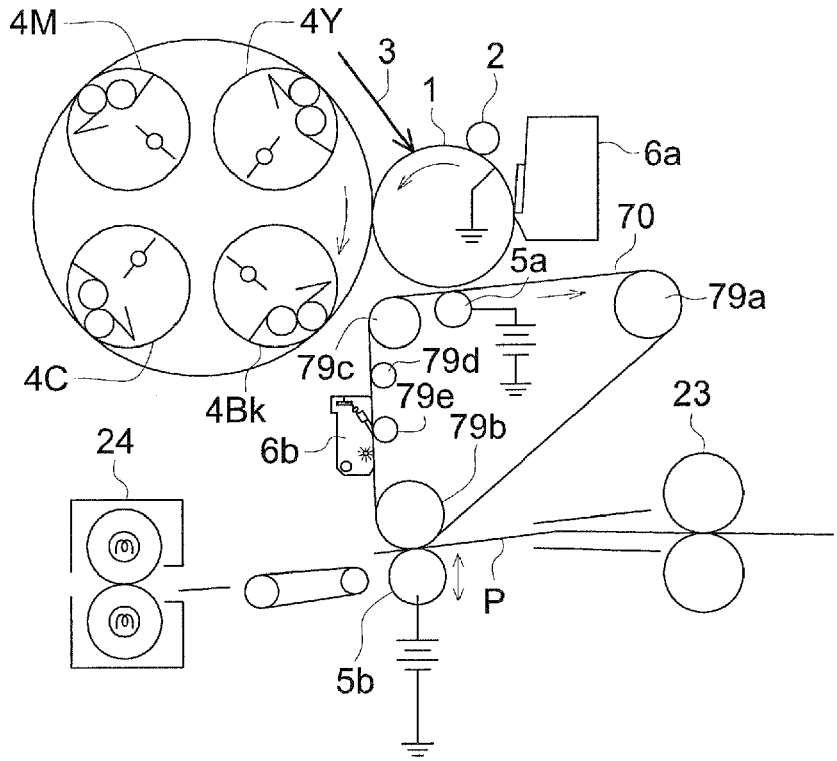
FIG. 3 shows a schematic cross-sectional diagram of color image forming apparatus fitted with an organic photoreceptor of the present invention.

Next, FIG. 3 shows a cross-sectional configuration diagram of a color image forming apparatus fitted with an organic photoreceptor of the present invention (a copier or a laser beam printer possessing at least a charging device, an exposure device, a plurality of developing devices, an image transfer device, a cleaning device, and an intermediate transfer member provided around the organic photoreceptor). An elastic body with a medium level of electrical resistivity is employed for belt shaped intermediate transfer member 70.

Numeral 1 represents a rotating drum type photoreceptor that is repetitively used as the image carrying body, and is driven to rotate with a specific circumferential velocity in the anti-clockwise direction indicated by the arrow.

During rotation, photoreceptor 1 is evenly charged to a specific polarity and potential by charging device (charging process) 2, and next, when it receives image exposure obtained via scanning exposure light with a laser beam modulated in accordance with the time-serial electrical digital pixel signal of the image information from image exposure device (image exposure process) 3 not shown in the figure, formed is an electrostatic latent image corresponding to yellow (Y) color component image (color information) as an intended color image.

Next, the electrostatic latent image is developed by yellow (Y) developing device: developing process (yellow color developing device) 4Y employing the yellow toner as the first color. In this case, the second developing device to the fourth developing device (magenta color developing device, cyan color developing device, and black color developing device) 4M, 4C, and 4Bk each are in the operation switched-off state and do not act on photoreceptor 1, and the yellow toner image of the above-described first color does not get affected by the above-described second developing device to fourth developing device.

Intermediate transfer member 70 is passed through rollers 79*a*, 79*b*, 79*c*, 79*d*, and 79*e* and is driven to rotate in a clockwise direction with the same circumferential speed as photoreceptor 1.

The yellow toner image of the first color formed and retained on photoreceptor 1 is, in the process of passing through the nip section between photoreceptor 1 and intermediate transfer member 70, intermediate-transferred (primary transferred) successively to the outer peripheral surface of intermediate transfer member 70 due to the electric field formed by the primary transfer bias voltage applied from primary transfer roller 5*a* to intermediate transfer member 70.

The surface of photoreceptor 1 after it has completed the transfer of the first color yellow toner image to intermediate transfer member 70 is cleaned by cleaning device 6*a*.

In the same manner as described above, the second color magenta toner image, the third color cyan toner image, and the fourth color black toner image are transferred successively on to intermediate transfer member 70 in a superimposing manner, thereby forming the superimposed color toner image corresponding to the intended color image.

Secondary transfer roller 5*b* is placed so that it is supported by bearings parallel to secondary transfer opposing roller 79*b* and pushes against intermediate transfer member 70 from below in a separable condition.

In order to carry out successive overlapping transfer of the toner images of the first to fourth colors from photoreceptor 1 to intermediate transfer member 70, the primary transfer bias voltage applied has a polarity opposite to that of the toner and is applied from the bias power supply. This applied voltage is, for example, in the range of +100 V to +2 kV.

During the primary transfer process of transferring the first to the third color toner image from photoreceptor 1 to intermediate transfer member 70, secondary transfer roller 5*b* and intermediate transfer member cleaning device 6*b* can be separated from intermediate transfer member 70.

The transfer of the superimposed color toner image transferred onto belt shaped intermediate transfer member 70 on to transfer material P which is the second image supporting body is done when secondary transfer roller 5*b* is in contact with the belt of intermediate transfer member 70, and transfer material P is fed from corresponding sheet feeding resist roller 23 via the transfer sheet guide to the contacting nip between secondary transfer roller 5*b* and intermediate transfer member 70 at a specific timing. The secondary transfer bias voltage is applied from the bias power supply to secondary image transfer roller 5*b*. Because of this secondary transfer bias voltage, the superimposed color toner image is transferred (secondary transfer) from intermediate transfer member 70 to transfer material P which is the second image supporting body. Transfer material P which has received the transfer of the toner image is guided to fixing device 24 and is heated and fixed there.

The image forming apparatus of the present invention is commonly suitable for electrophotographic apparatuses such as electrophotographic copiers, laser printers, LED printers, liquid crystal shutter type printers and so forth. Further, the image forming apparatus can be widely utilized for apparatuses for displaying, recording, light printing, plate making and facsimile applied from an electrophotographic technique.

EXAMPLE

Next, the present invention will be described in detail referring to Examples, but embodiments of the present invention are not limited thereto. In addition, "parts" described below represents "parts by weight".

(Preparation of Porous Silica (KS-1) in which Titanium Dioxide is Encapsulated)

A suspension in which 50% by oxide of rutile type titanium dioxide having a number average primary particle diameter of 10 nm, having been subjected to a hydrophobization treatment with methylhydrogen siloxane was mixed in an ethyl acetate solution of 2.0% by weight polyoxyethylene laurylether (n=10) was prepared to maintain the suspended form while stirring at high speed. Into 100 ml of this suspension, added was 500 ml of water glass No. 1 (4 mol/liter of $SiO_2$) to prepare an O/W type emulsion via stirring at high speed. The resulting was added into 3.0% by weight of polyoxyethylene laurylether and 2000 ml of ethyl acetate to an O/W/O type emulsion via stirring at high speed.

One mol/litter of the O/W/O type emulsion obtained as described above was added into 3000 ml of ammonium sulfate to conduct reaction while stirring, the resulting was left standing for 2 hours for filtering separation, and ethyl acetate in porous silica particles was vaporized via washing and drying to obtain 110 g of the porous silica particles occupying 50% of titanium dioxide in weight ratio. These particles were classified to obtain porous silica in which titanium dioxide having a number average primary particle diameter of 0.4 μm was encapsulated. The porous silica in which the titanium dioxide was encapsulated was subjected to a hexamethyl silazane treatment in order to hydrophobize the surface, whereby porous silica (KS-1) in which titanium dioxide was encapsulated was obtained.

(Preparation of Porous Silica (KS-2) to Porous Silica (KS-14) in which Each Kind of Metal Oxide is Encapsulated)

Each of porous silica (KS-2)-porous silica (KS-14) in which each kind of metal oxide was encapsulated was prepared similarly to preparation of porous silica in which the foregoing titanium dioxide was encapsulated, except that titanium dioxide was replaced by various kinds of oxide particles shown in Table 1.

TABLE 1

| | Core of particle | | | Shell of particle | | |
|---|---|---|---|---|---|---|
| *1 | Kinds | Number average primary particle diameter (nm) | *2 | Kinds | Number average primary particle diameter (μm) | *2 |
| KS-1 | Titanium dioxide | 10 | MHS | Porous silica | 0.3 | HMD |
| KS-2 | Alumina | 250 | MHS | Porous silica | 0.8 | HMD |
| KS-3 | Zinc oxide | 20 | MHS | Porous silica | 0.3 | HMD |
| KS-4 | Tin oxide | 40 | MHS | Porous silica | 0.3 | HMD |
| KS-5 | Titanium dioxide | 25 | MHS | Porous silica | 0.3 | HMD |
| KS-6 | Alumina | 70 | MHS | Porous silica | 0.4 | HMD |
| KS-7 | Zinc oxide | 190 | MHS | Porous silica | 0.8 | HMD |
| KS-8 | Tin oxide | 120 | MHS | Porous silica | 0.6 | HMD |
| KS-9 | Titanium dioxide | 40 | MHS | Porous silica | 0.3 | HMD |
| KS-10 | Alumina | 30 | MHS | Porous silica | 0.3 | HMD |
| KS-11 | Titanium dioxide | 100 | MHS | Porous silica | 0.5 | HMD |
| KS-12 | Titanium dioxide | 230 | MHS | Porous silica | 0.8 | HMD |
| KS-13 | Titanium dioxide | 260 | MHS | Porous silica | 0.8 | HMD |
| KS-14 | Titanium dioxide | 350 | MHS | Porous silica | 0.9 | HMD |
| Silica 1 | — | — | — | Porous silica | 0.3 | HMD |
| Silica 2 | Silica | 220 | MHS | — | — | — |
| Titanium dioxide 1 | Titanium dioxide | 40 | HMD | — | — | — |
| Titanium dioxide 2 | Titanium dioxide | 260 | HMD | — | — | — |

*1: Particle contained in intermediate layer

*2: Surface treatment agent

MHS: Methylhydrogen siloxane

HMD: Hexamethyl silazane

Preparation of Photoreceptor 1

Photoreceptor 1 was prepared as described below.

The surface of a cylindrical aluminum support was subjected to a cutting work to prepare a conductive support having a 10 points surface roughness Rz of 0.4 μm.

<Intermediate Layer>

Intermediate Layer 1

The following intermediate layer coating solution was coated on the above-described conductive support by an immersion coating method, followed by drying at 120° C. for 30 minutes to form intermediate layer 1 having a dry thickness of 5.0 μm.

The following intermediate layer dispersion was diluted twice with the same mixed solvent, followed by filtration (filter; Rigimesh filter, produced by Pall Corporation with a nominal filtration accuracy of 5 μm and a pressure of 50 kPa) to prepare an intermediate layer coating solution.

| (Preparation of intermediate layer dispersion) | |
|---|---|
| Binder resin; (exemplified polyamide N-1) | 1 part (1.00 part by volume) |
| Porous silica (KS-1) in which metal oxide is capsulated, which is described in Table 1 | 5.0 parts |
| Ethanol/n-propylalcohol/THF (=45/20/30 weight ratio) | 10 parts |

The above-described components were mixed, dispersing was conducted for 10 hours by a batch system, employing a sand mill homogenizer to prepare an intermediate layer dispersion.

| <Charge generation layer: CGL> | |
|---|---|
| Charge generation material; A titanylphthalocyanine pigment having the maximum diffraction peak at an position of at least 27.3° on Bragg angle (2θ ± 0.2°) in a Cu-Kα characteristic X-ray diffraction spectrum. | 24 parts |
| Polyvinyl butyral resin "S-LEC BL-1" (produced by Sekisui Chemical Co., Ltd.) | 12 parts |
| 2-butanone/cyclohexanone = 4/1 (v/v) | 300 parts |

The above-described compositions were mixed and dispersed employing the sand mill to prepare a charge generation layer coating solution. This coating solution was coated on the intermediate layer by a dip coating method to form a charge generation layer having a dry thickness of 0.5 μm.

| <Charge transport layer (CTL)> | |
|---|---|
| Charge transport material(CTM); (the following CTM-1) | 225 parts |
| Polycarbonate (Z300, produced by Mitsubishi Gas Chemical Company Inc.) | 300 parts |
| Antioxidant (the following AO 1-1) | 6 parts |
| THF/Toluene mixed liquid (mixture of 3/1 in volume ratio) | 2000 parts |
| Silicone oil (KF-54: produced by Shin-Etsu Chemical Co., Ltd.) | 1 Part |

The above-described compositions were mixed and dissolved to prepare charge transport layer coating solution 1. This coating solution was coated on the foregoing charge generation layer by an immersion coating method, followed by drying at 110° C. for 70 minutes to form charge transport layer 1 having a dry thickness of 20.0 μm, whereby photoreceptor 1 was prepared.

AO-1

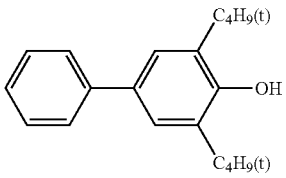

-continued

CTM-1

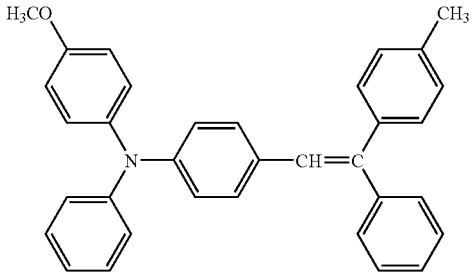

Photoreceptors 2-14

Photoreceptors 2-14 were prepared similarly to preparation of photoreceptor 1, except that porous silica (KS-1), in which metal oxide was encapsulated, in an intermediate layer was replaced by porous silica (KS-2) in which metal oxide was encapsulated—porous silica (KS-14) in which metal oxide was encapsulated, respectively.

Photoreceptors 15-18 (Comparative Examples)

Photoreceptors 15 and 16 were prepared similarly to preparation of photoreceptor 1, except that porous silica (KS-1), in which metal oxide was encapsulated, in an intermediate layer was replaced by silica 1 and silica 2 as shown in Table 1, respectively. Herein, in the case of silica 1, the shell is formed of the same material as that of the shell in KS-1, but silica 1 means a particle where metal oxide is not encapsulated in the core. In addition, silica 2 means no porous material prepared via a vapor deposition method, and also means a silica particle having no core/shell structure. Further, photoreceptors 17 and 18 were prepared similarly to preparation of photoreceptor 1, except that porous silica (KS-1), in which metal oxide was encapsulated, in an intermediate layer was replaced by titanium dioxide 1 and titanium dioxide 2 as shown in Table 1, respectively.

{Evaluation 1}

A photoreceptor obtained as described above was installed in a remodeled machine of a commercially available full-color composite copier bizhub PRO C6500 (manufactured by Konica Minolta Business Technologies, Inc.) having a configuration shown in FIG. 2, which is capable of varying a writing dot diameter thereof, and then the exposure light diameter in the main scanning direction of the writing light source was 30 μm at 1200 dpi by using a laser light source having a wavelength of 780 nm as a setting of an image exposure light source. The setting was made in such a way that the spot exposure of the exposure light diameter was set at 0.5 mW on the photoreceptor surface. In addition, since the above-described full-color composite copier possesses four sets of image forming units, photoreceptors in each of the image forming units are unified with the same kind of photoreceptors (for example, four pieces of photoreceptor 1 arranged in the case of photoreceptor 1) to make evaluations. Each evaluation was made at 30° C. and 80 RH %.

Evaluation Items and Evaluation Criteria

Moire (Evaluated in Black-White Image)

Halftone images were printed on A4 size paper sheets to make evaluation based on the following criteria.

5: Interference fringe is seen only in less than 1% of the halftone image area. (Excellent)

4: Interference fringe is generated in 1-5% of an A4 size paper sheet area. (Comparatively good)

3: Interference fringe is generated in 6-10% of an A4 size paper sheet area. (with no practical problem)

2: Interference fringe is generated in 11-30% of an A4 size paper sheet area. (with a practical problem)

1: Interference fringe is generated in 31-50% of an A4 size paper sheet area. (with a practical problem)

0: Interference fringe is generated in at least 51% of an A4 size paper sheet area. (with a practical problem)

Black Spots (Evaluated in Black-White Image)

Visualized black spots or image defects in the form of black streaks in which the periodicity coincides with the photoreceptor cycle were determined by the number per A4 size. Ten black-white images were printed on the A4 size paper sheet to make evaluations based on the following criteria.

A: Frequency of the image defect of at least 0.4 mm; all the printed images exhibiting not more than 5 per A4 size. (Excellent)

B: Frequency of the image defect of at least 0.4 mm; at least one printed image exhibiting at least 6 and not more than 10 per A4 size. (with no practical problem)

C: Frequency of the image defect of at least 0.4 mm; at least one printed image exhibiting at least 11 per A4 size. (with a practical problem)

TABLE 2

| Photo-receptor No. | Kinds of particle contained in intermediate layer | Evaluation | | Remarks |
|---|---|---|---|---|
| | | Moire | Black spots | |
| 1 | KS-1 | 3 | A | Within the present invention |
| 2 | KS-2 | 4 | A | Within the present invention |
| 3 | KS-3 | 3 | A | Within the present invention |
| 4 | KS-4 | 4 | A | Within the present invention |
| 5 | KS-5 | 3 | A | Within the present invention |
| 6 | KS-6 | 4 | A | Within the present invention |
| 7 | KS-7 | 4 | A | Within the present invention |
| 8 | KS-8 | 4 | A | Within the present invention |
| 9 | KS-9 | 5 | A | Within the present invention |
| 10 | KS-10 | 4 | A | Within the present invention |
| 11 | KS-11 | 5 | A | Within the present invention |
| 12 | KS-12 | 5 | A | Within the present invention |
| 13 | KS-13 | 4 | A | Within the present invention |
| 14 | KS-14 | 4 | B | Within the present invention |
| 15 | Silica 1 | 2 | B | Outside the present invention |
| 16 | Silica 2 | 0 | C | Outside the present invention |
| 17 | Titanium dioxide 1 | 2 | B | Outside the present invention |
| 18 | Titanium dioxide 2 | 2 | C | Outside the present invention |

As is clear from Table 2, it is to be understood that each of photoreceptors 1-14 of the present invention possessing an intermediate layer containing porous silica in which metal oxide is encapsulated exhibits an excellent result in each evaluation item, but each of photoreceptors 1-14 as a comparative example exhibits a practically unsatisfactory result in some of the evaluation items.

Effect of the Invention

Not only an organic photoreceptor exhibiting extremely high moire resistance can be provided, but also the organic photoreceptor capable of acquiring a high quality image with no generation of image defects such as black spots or the like can be provided by utilizing the organic photoreceptor of the present invention, and an image forming apparatus and a process cartridge employing the organic photoreceptor can also be provided.

What is claimed is:

1. An organic photoreceptor comprising a conductive support and layered thereon, an intermediate layer, a charge generation layer and a charge transport layer in this order, wherein the intermediate layer comprises porous silica in which metal oxide is encapsulated.

2. The organic photoreceptor of claim 1, wherein the metal oxide comprises at least one selected from the group consisting of a titanium dioxide particle, an alumina particle, a zinc oxide particle and a tin oxide particle.

3. The organic photoreceptor of claim 1, wherein the porous silica is subjected to a hexamethyl silazane treatment.

4. An image forming apparatus to repeatedly conduct image formation, comprising an organic photoreceptor and provided thereabout, a charging device, an exposure device equipped with a coherent light source and a reversal development device, wherein the organic photoreceptor comprises the organic photoreceptor of claim 1.

5. The image forming apparatus of claim 4, further comprising a process cartridge comprising at least one of a charging device, an image exposure light source and a developing device, integrally supported with the organic photoreceptor, the process cartridge removable from the image forming apparatus.

* * * * *